United States Patent [19]

Sanborn

[11] 4,407,229

[45] Oct. 4, 1983

[54] DIP TANK HOIST

[76] Inventor: Dale Sanborn, South Waterford, Me. 04081

[21] Appl. No.: 284,977

[22] Filed: Jul. 20, 1981

[51] Int. Cl.[3] ..... B05C 3/09

[52] U.S. Cl. ..... 118/702; 118/703; 118/704; 118/425; 134/165

[58] Field of Search ..... 134/57 R, 58, 164, 165; 118/425, 699, 700, 701, 702, 703, 704, 697

[56] References Cited

U.S. PATENT DOCUMENTS

| | | | |
|---|---|---|---|
| 2,912,989 | 11/1959 | Bordin | 134/164 |
| 3,426,772 | 2/1969 | Foster | 134/164 |
| 3,461,008 | 8/1969 | Laurie | 134/164 |

*Primary Examiner*—Robert L. Bleutge

*Attorney, Agent, or Firm*—McCormick, Paulding & Huber

[57] ABSTRACT

A hoist for dipping a package of lumber or other similar work product into a tank of liquid is fabricated basically as a weldment of readily available steel shapes and is of a rugged, reliable design. A vertically movable carriage with forwardly projecting prongs at its lower end receives a package of work product and clamps located above the prongs tightly clamp the package to the carriage during a dipping procedure. The hoist is designed to allow package delivery and removal, to and from the hoist, by a fork lift truck. After placing a package on the hoist the fork lift operator may push a single push button and a control system for the hoist thereafter causes the hoist to automatically go through a full cycle of operation including a immersion period the length of which may be manually adjusted.

14 Claims, 5 Drawing Figures

DIP TANK HOIST

BACKGROUND OF THE INVENTION

This invention relates to dip tanks for treating generally rectangular packages of lumber or similar work product, and deals more particularly with a hoist for lowering and raising the packages into and out of the tank.

The hoist of this invention was conceived for use in treating packages of lumber with a liquid agent and is therefore shown and described herein as applied to such use. It should be understood, however, that the hoist is not necessarily limited to handling packages of lumber and can be used with other products capable of being assembled into relatively large packages or bundles.

In the case of white pine, for example, lumber is susceptible to attack by a fungus which discolors it, producing blue stain. To prevent this blue stain it has been customary in the past to spray white pine lumber with a liquid fungicide. This spray, however, is somewhat difficult to control and, despite precautions, tends to come into contact with people and to pollute work areas.

The hoist of the invention overcomes the problem of treating lumber with a chemical spray by enabling packages of lumber to be conveniently dipped in a tank of liquid fungicide or other treatment agent.

It is therefore an object of the invention to provide a hoist mechanism for use in raising and lowering relatively large packages or bundles of work product into and out of an associated dip tank and which hoist mechanism is of a simple, rugged and reliable construction.

Another object of the invention is to provide a hoist mechanism of the foregoing character having an associated control system such that after a package is placed on the hoist and a push button pressed, the hoist will automatically undergo a full cycle of operation without further attention.

A still further object of the invention is to provide a hoist mechanism which is hydraulically operated and wherein the pump for the hydraulic system is driven only at times when hydraulic power is needed.

Other objects and advantages of the invention will be apparent from the drawings and from the following detailed description thereof.

SUMMARY OF THE INVENTION

The invention resides in a hoist adapted for use with a dip tank for applying a liquid agent to relatively large packages of lumber of similar work product. A vertically movable carriage has forwardly projecting prongs on which a package may be placed, and above the prongs is a clamp means which is movable into engagement with a received package to firmly hold the package to the carriage during the dipping process.

The invention more specifically resides in the hoist having a stationary frame including two vertical posts having their lower ends in the tank and their upper ends extending upwardly out of the tank. The carriage is slidably supported by these two posts and has two vertical side members each extending along a portion of one of the frame posts. Each carriage side member slidably supports a clamp which is movable vertically relative to the carriage side member into and out of engagement with a package received on the carriage prongs. The carriage is movable relative to the stationary frame by a hydraulic cylinder and the two clamps are movable relative to the remainder of the carriage by two other hydraulic cylinders. These three cylinders are controlled by a control system comprised basically of solenoid valves, limit switches and relays causing the clamps and carriage to undergo a full cycle of operation upon the operation of a single push button.

The invention still further resides in the control system being such that the motor for the hydraulic pump which supplies hydraulic fluid to the cylinders is turned on only at times when pressurized hydraulic fluid is required to operate the cylinders and is turned off at other times.

DETAILED DESCRIPTION OF THE PREFERRED EMBODIMENT

Figure 1:
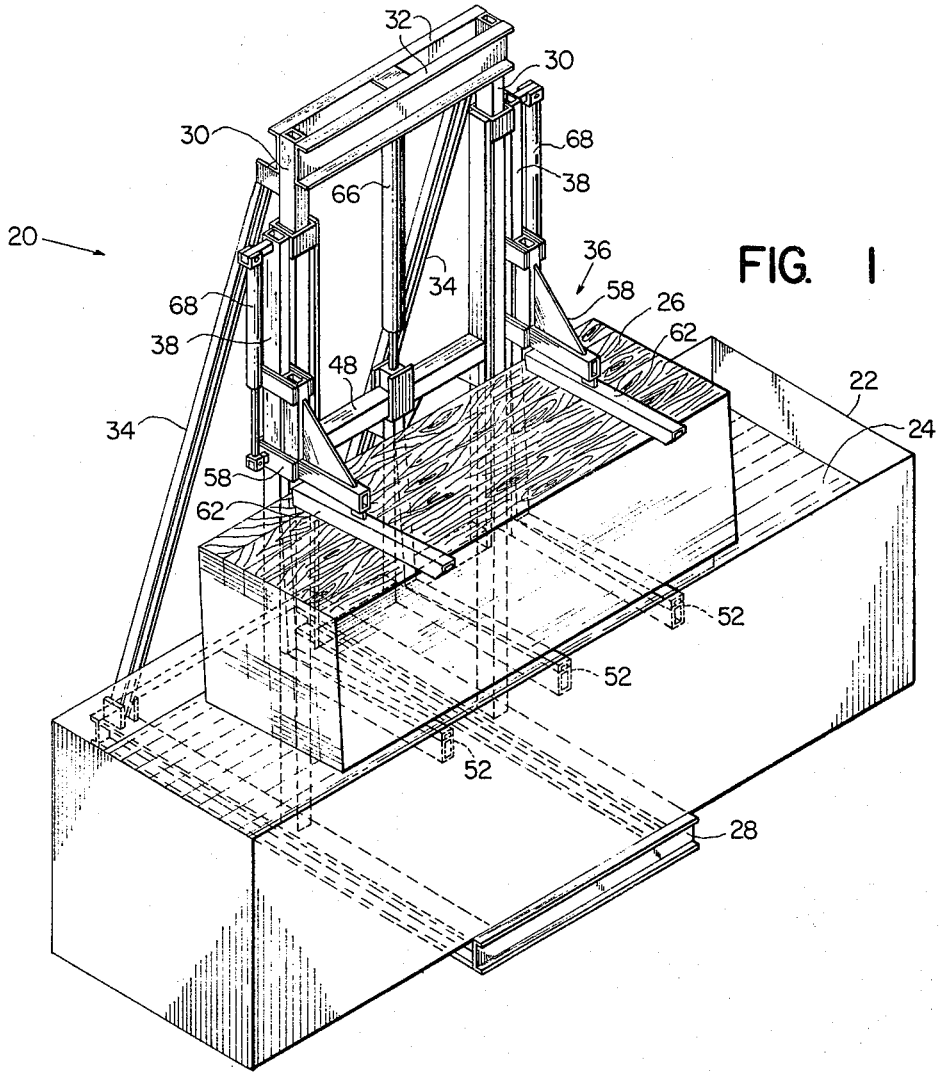
FIG. 1 is a perspective view showing a dip tank together with a hoist embodying the present invention.
Figure 3:
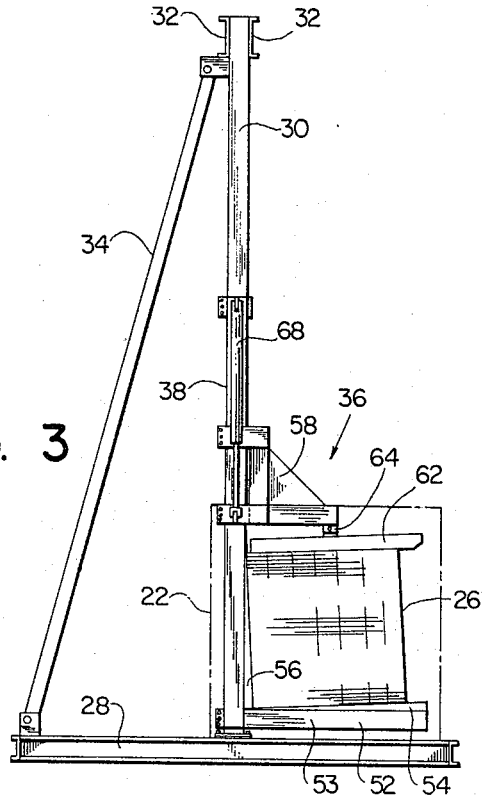
FIG. 3 is a side elevational view of the hoist of FIG. 1.
Figure 2:
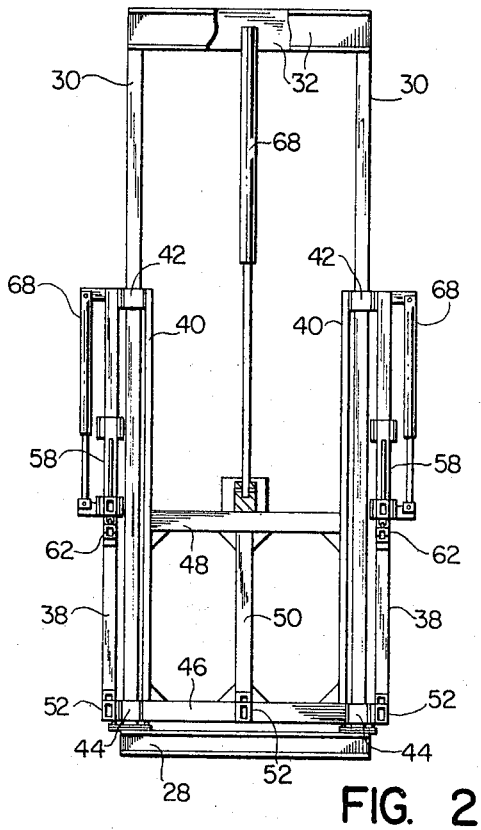
FIG. 2 is a front elevational view of the hoist of FIG. 1.

Referring to the drawings, and first considering FIGS. 1, 2 and 3, a hoist embodying this invention is indicated generally at 20 and is associated with a dip tank 22 containing a quantity of liquid 24. The tank 22 may vary in size depending on the size of the articles to be treated, but in the illustrated case the tank may be taken to be about six feet wide, six feet deep and twenty feet long and made of one-fourth inch thick steel plate with an open top. In FIG. 1, the articles to be treated by the dip tank and hoist are taken to be packages of lumber, one of which is shown at 26. The size of these packages can vary depending on mill methods of processing the lumber. They are, however, substantially rectangular in shape and in the illustrated case may have a size of about four feet wide, four feet high and twelve feet to sixteen feet long.

The hoist 20 is made largely as weldments of steel members of channel, tubular box, and other standard sections and has a stationary frame including a platform 28, made of channel members, on which the tank 22 rests. Two vertical posts 30, 30, located toward the rear of the tank, have lower end portions extending into the tank 24 and upper end portions which extend some distance upwardly beyond the tank. The lower ends of the posts 30, 30 are connected to the platform 28 through the bottom wall of the tank 22. The upper ends of the two posts 30, 30 are connected together by two channel member cross pieces 32, 32. Two inclined struts 34, 34 extend between the rear end of the platform 28 and the upper end of each vertical post 30 to firmly hold the posts 30, 30, each of which is made of steel box tubing, in their upright positions.

A carriage, indicated generally at 36, is supported for vertical sliding movement on the posts 30, 30. This carriage includes two side members 38, 38, also made of steel box tubing, each located outboard of, and extending along a portion of, a respective one of the stationary posts 30, 30. The carriage also has two other side members 40, 40 each located inboard of one of the stationary posts 30, 30. An upper bearing 42 is connected between each pair of side carriage members 38 and 40 at their upper ends and likewise a lower bearing 44 is connected to each pair of side members 38 and 40 at their lower ends. The bearings 42, 42 and 44, 44 surround the stationary posts 30, 30 and slidably support the carriage 36 for vertical movement relative to the posts. Preferably, each of these bearings is lined with a ultra-high molecular weight plastic for direct engagement with the outside surface of the associated post.

At their lower ends the two inboard carriage side members 40, 40 are joined by a cross piece 46 and midway between their length they are joined by another cross piece 48. As seen in FIG. 2, midway between the length of the carriage cross pieces 46 and 48 is a vertical piece 50 made of box tubing welded to the two cross pieces and located in the same plane as the carriage side members 38, 38.

At the lower end of the carriage are three forwardly projecting prongs 52, 52 made of box tubing and having their rear ends respectively connected to the lower ends of the two carriage side posts 38, 38 and to the lower end of the vertical mid-piece 50. As shown best in FIG. 3, each prong 52 is made of a substantially horizontal length of box tubing 53 with a tapered length of box tubing 54 welded to its upper face to give the prong a slightly inclined upwardly facing surface for engaging the bottom surface of the received package 26. In cooperation with this each of the two side posts 38, 38 and the mid-piece 50 has a tapered section 56 of box tubing welded to its forward face to provide a face for engaging the rear surface of the received package 26 which face is perpendicular to the upwardly facing package engaging surface of the prongs. Therefore, the package 26 is held in a slightly inclined or tipped position on the carriage 36 which promotes drainage of treatment liquid from the package after the package has been raised from the tank.

Above the prongs 52, 52 the carriage 36 has a clamp means for securely clamping a package to the carriage during a dipping process. This clamp means includes two clamp carriers 58, 58 each slidably received on a respective one of the carriage side members 38, 38 by two bearings 60, 60 each preferably lined with ultra-high molecular weight plastic material for sliding engagement with the side members 38, 38. Each clamp carrier 58 in turn carries a package engaging clamp bar 62 which is pivotally connected intermediate its length to the clamp carrier for swinging movement about a horizontal pivot axis, indicated at 64, perpendicular to the clamp bar.

The entire carriage 36, with its received package 26, is moved vertically by a hydraulic cylinder 66 connected between the frame cross pieces 32, 32 and the carriage cross piece 48. The two clamp carriers 58, 58 are moved vertically relative to the carriage side posts 38, 38 by two hydraulic cylinders 68, 68 each connected between the upper end of the associated side member 38 and the associated clamp carrier 58. A suitable hydraulic pump, pump motor, solenoid valves and other control components, not shown in FIGS. 1, 2 and 3, are also provided for the hoist. These are preferably combined into a unitary package or module and placed at a convenient location, such as on a platform extending between and carried by the rear struts 34, 34.

In the use of the hoist 20 a cycle of operation starts with the carriage 36 raised to its uppermost position at which the prongs 52, 52 are located somewhat above the top of the tank 22. At this time the carriage is empty of any package and the two clamp carriers 58, 58 are raised to their upper limits. A package is then set onto the carriage prongs by an operator using a fork lift truck. The operator then removes the fork lift truck from the package and operates a "cycle" push button to start a cycle of operation. In the performance of this cycle the clamp carriers 58, 58 are first lowered to bring the clamp bars 62, 62 into firm engagement with the top of the received package 26 and to hold the package between the clamp bars 62, 62 and the prongs 52, 52. The carriage is then lowered, by the cylinder 66, to its fully lowered position, shown in FIG. 3, causing the received package 26 to be submerged in the dip tank liquid. The package is held in this submerged condition for a predetermined time period at the end of which the package is again raised. When the carriage again reaches its fully raised position the clamp carriers 58, 58 are moved upwardly to release the clamp bars 62, 62 from the package. This completes the cycle of operation of the hoist mechanism. The package is then allowed to remain in this raised position for sufficient time to allow unabsorbed liquid to drain from it and fall back into the dip. The package is then removed by a fork lift truck and the hoist is free to accept a fresh package of lumber and to undergo another cycle of operation.

Figure 4:
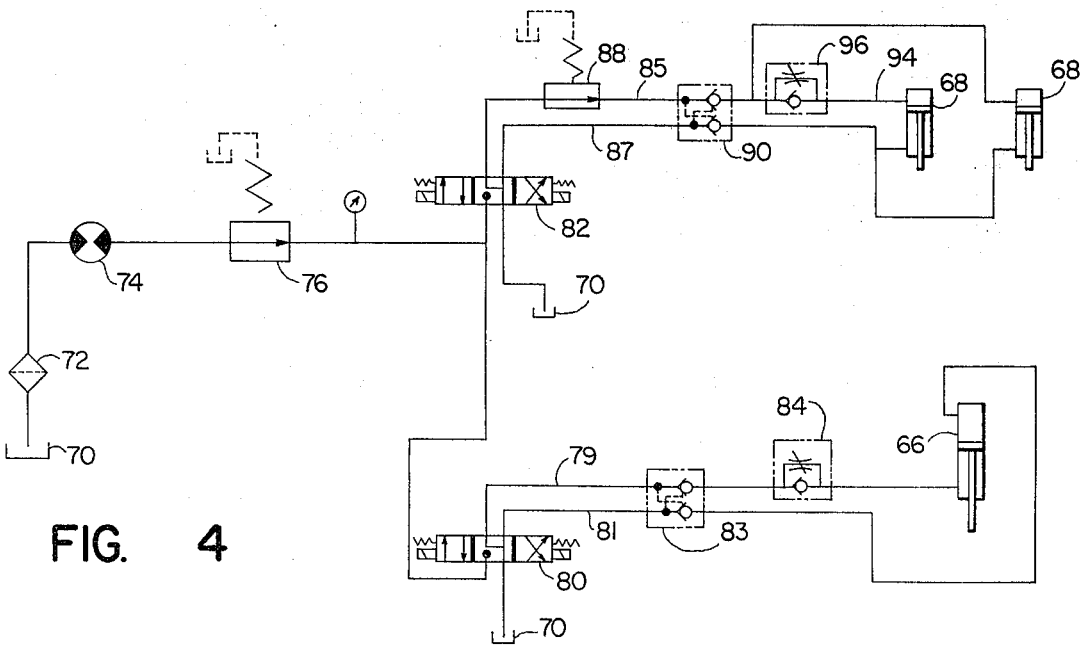
FIG. 4 is a schematic diagram showing the hydraulic portion of the control system for the hoist of FIG. 1.
Figure 5:
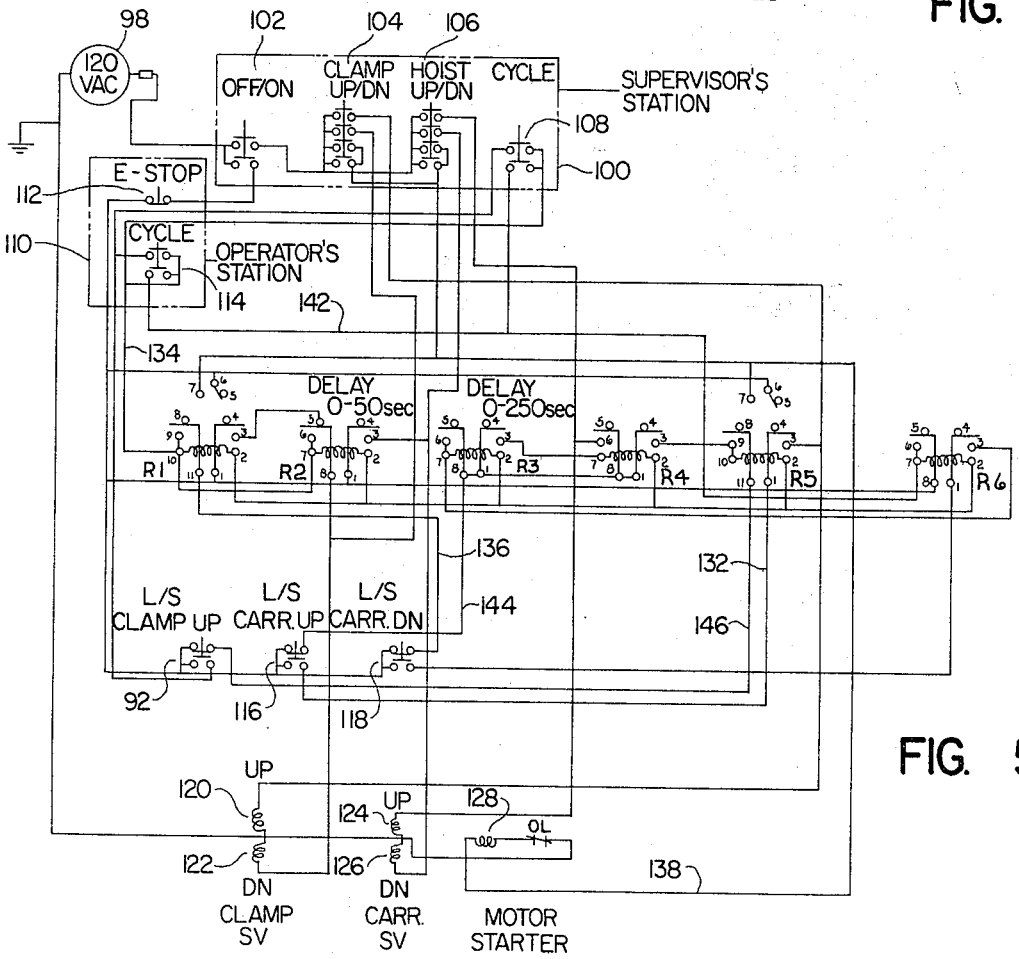
FIG. 5 is a schematic diagram showing the electrical portion of the control system for the hoist of FIG. 1.

An electro-hydraulic control system for operating the hoist 20 is shown in FIGS. 4 and 5, with FIG. 4 showing the hydraulic portion of the system and FIG. 5 showing the electrical portion. Referring to these two figures, and first considering FIG. 4, the hydraulic portion of the control system includes a reservoir 70 of hydraulic fluid, a suction strainer 72 and a pump 74 which delivers pressurized hydraulic fluid to a supply line 78 through a first relief valve 76 set to a relief pressure equal to the maximum pressure required by the hoist cylinder 66. The supply line 78 is in turn connected to a solenoid valve 80 for the hoist cylinder 66 and another solenoid valve 82 for the two clamp cylinders 68, 68. As shown, the carriage solenoid valve 80 is connected to the carriage cylinder 66 by two lines 79 and 81 through a locking valve 83 and the line 79 connected to the rod end of the cylinder includes a flow control valve 84 containing a check valve and adjustable needle valve in parallel. The check valve permits unimpeded supply of hydraulic fluid to the carriage cylinder 66 when the cylinder is operated to raise the carriage, and the needle valve slows the exhaust of hydraulic fluid from the rod end of the cylinder during lowering movement of the carriage, this preventing the carriage from moving downwardly too fast under the influence of the weight of the package placed on the carriage. The locking valve 83 locks the cylinder 66 in its given position when the solenoid valve 80 is in its neutral position, shown in FIG. 4, at which no pressurized fluid is supplied to either of the lines associated with the cylinder 66. When supply pressure is supplied to one of the two lines 79 or 81, however, the locking valve unseats the check valve in the other line to allow reverse flow in such other line.

The clamp solenoid 82 is connected to the two clamp cylinders 68, 68 in parallel through two lines 85 and 87. The line 85, which is pressurized when the clamps are moved downwardly, includes a second relief valve 88 which is set to a lower pressure than the first relief valve 76. For example, the first relief valve 76 may be set to a relief pressure of 800 psi and the second relief valve 88 set to a relief pressure of 400 psi. By doing this the pressure exerted by the clamps on the package is held to value not likely to damage or break the lumber of the package while nevertheless assuring sufficient pressure to the carriage cylinder 66 to raise the carriage. A locking valve 90, similar to the locking valve 83, is included in the two lines 85 and 87 to cause the two clamp cylinders 68, 68 to hold their given positions when pressurized hydraulic fluid is absent in both of the lines 85, 87.

The left clamp cylinder 68 of FIG. 4 has associated with it a limit switch, shown in FIG. 5 at 92, for indicating the raised limit of its associated clamp carrier 58. In the line 94 connected to the head end of this cylinder is a flow control valve 96 having a check valve permitting unimpeded flow to the head end of the cylinder and an adjustable needle valve slowing the exhaust of fluid from the head end of the cylinder. This arrangement assures that during the raising of the clamps by the two cylinders 68, 68 the right-hand cylinder 68 and its clamp carrier 58 will reach their raised positions first so that when the clamp up limit switch 92 is operated by the left-hand cylinder 68 and its clamp carrier reaching their raised positions both clamp carriers will be in their clamp up or fully raised positions.

Referring to FIG. 5, the electrical portion of the control system includes a source of electrical power such as the indicated 120 volt a.c. source 98. A supervisor's station 100 includes an on/off switch for connecting the system to and from the source 98, a clamp up/-down switch 104 for manually commanding up and down movement of the clamps, a hoist up/down switch for manually commanding up and down movement of the carriage and a cycle switch 108 for use in initiating a cycle of operation. An operator's station 110 includes an emergency stop push button 112 and a cycle push button 114 connected in parallel with the similar push button 108 of the supervisor's station. The two buttons 112 and 114 of the operator's station are preferably mounted at a location near the front of the tank 22 so as to be readily accessible and easily reached by the fork lift truck operator so that after the operator has placed a package on the carriage he can, without leaving his truck, push the cycle push button 114 to initiate a cycle of hoist operation.

Also included in the electrical portion of the control system, as shown in FIG. 5, are six relays R1 to R6, the clamp up limit switch 92, a carriage up limit switch 116, a carriage down limit switch 118, the up and down coils 120 and 122 of the clamp solenoid 82, the up and down coils 124 and 126 of the carriage solenoid 80 and the winding 128 of a motor relay for turning on and off the motor for the hydraulic pump 74. In FIG. 5 the limit switches 92, 116 and 118 and the relays R1 to R6 are shown in their unoperated conditions. The relays R2, R3, R4 and R6 are two pole relays. That is, each has a coil connected between its terminals 2 and 7 and each has two movable contacts. In the unoperated condition one movable contact connects terminal 1 to terminal 4 and the other movable contact connects terminal 8 to terminal 5. In the operated condition the one movable contact connects terminal 1 to terminal 3 and the other movable contact connects terminal 8 to terminal 6. Relays R1 and R5 are three pole relays with each having a coil connected between terminals 2 and 10 and three movable contacts. In the unoperated condition the first movable contact connects terminal 1 to terminal 4, the second movable contact connects terminal 6 to terminal 5 and the third movable contact connects terminal 11 to terminal 8, whereas in the operated condition the first movable contact connects terminal 1 to terminal 3, the second movable contact connects terminal 6 to terminal 7 and the third movable contact connects terminal 11 to terminal 9.

Having now described the components of the electro-hydraulic control system shown in FIGS. 4 and 5 a cycle of its operation may be described as follows. At the beginning of a cycle the carriage 36 is in its raised or up position and the clamp carriers 58, 58 are likewise in their raised or up position. The motor relay coil 128 is deenergized and the clamp up limit switch 92 is operated, thereby supplying power to the cycle push button 114 over the line 130 of FIG. 5.

A cycle of hoist operation is started by pushing the cycle push button 114, assuming that the on/off switch 102 and the emergency stop switch 112 are both closed. When the cycle push button is pressed, its power is applied to the line 134 which operates relay R1, and upon such operation the relay is held on through its now closed terminals 9 and 11 by power appearing on the line 136 through the carriage down limit switch 118. Power is also supplied to the motor relay coil 128, to turn the motor on and run the hydraulic pump 74, through the now closed contact terminals 6 and 7 of R1 and through line 138. Also, the clamp down solenoid coil 122 is energized, over the line 140 and through the now closed terminals 1 and 3 of R1 and the closed terminals 8 and 5 of R2. R2 is also energized with power from terminal 10 of R1, but this relay is a time delay relay so that the contacts do not shift until the running of the time delay period. Preferably the relay R2 is one having an adjustable time delay period of about zero to fifty second and it is set to provide a time delay period sufficient to assure movement of the clamps from their raised position into firm engagement with the package received on the carriage. Generally a time delay setting of five to ten seconds on the relay R2 is sufficient for this purpose. It should also be noted that when the cycle push button 114 is operated the relay R6 is also energized over line 142 and is thereafter held on by the closed connection between its terminals 6 and 8.

As a result of the energization of the clamp down solenoid coil 122 the clamp bars 62, 62 are moved down into engagement with the package on the carriage and thereafter relay R2 times out and its two contacts shift position. The breaking of the connection between terminals 5 and 8 of relay R2 deenergizes the clamp down solenoid coil 122 and thereupon the clamp solenoid 82 is shifted to its neutral position and the clamp cylinders are locked in their end positions by the locking valve 90. Also, upon the shifting of the relay R2 the carriage down solenoid coil 126 is energized through terminals 1 and 3 of R2.

Because of the energization of the carriage down solenoid coil 126 the carriage is moved down through the operation of the carriage solenoid valve 80 and the carriage cylinder 86. At this time the adjustable flow control valve 84 in the line connected to the rod end of the cylinder dampens the speed of downward movement of the carriage to prevent the carriage from traveling too fast under the weight of the package received on the carriage. When the carriage reaches its lower limit of travel the carriage down limit switch 118 is operated. This deenergizes relay R1 by removing power from the line 136. The deenergization of R1 in turn turns off the motor by deenergizing the motor relay coil 128 through the opening of terminals 9 and 11 of R1. Also, relay R3 is energized through the carriage down limit switch 118 and through terminals 1 and 3 of relay R6.

Relay R3 is a time delay relay and preferably has an adjustable time delay period of from zero to about 250 seconds. Upon energization of relay R3 its contacts do not shift until the running of its set time delay period which determines the amount of time the carriage and its package remain immersed in the tank. That is, upon the energization of the relay R3 no further operation takes place until the running of time delay period and accordingly the carriage remains in its down position during that period.

After relay R3 times out, its contacts shift. Relay R4 is then energized through the carriage up limit switch 116 and through terminals 1 and 3 of R3. The energization of R4, in turn, causes the carriage up solenoid coil 124 to be energized through its terminals 6 and 8 thereupon the carriage starts to move upwardly through the action of the carriage cylinder 66. Also, relay R5 is energized through now closed terminals 1 and 3 of relay R4. The energization of relay R5 causes the motor to be started by application of power to the motor relay winding 128 through closed contacts 6 and 7 of R5, and R5 is held on through its now closed terminals 9 and 11 and through clamp up limit switch 92.

As mentioned, due to the energization of the carriage up solenoid coil 124 the carriage moves upwardly to raise itself and its package out of the dip tank, and when it reaches the upper limit of its movement it operates carriage up limit switch 116. Upon the operation of the limit switch 116, relay R3 and relay R4 are both deenergized by the removal of power from line 144. The carriage up solenoid coil 124 is thereupon deenergized by the opening of the terminals 6 and 8 of relay R4, with the carriage solenoid 80 shifting to its neutral position and with the carriage cylinder 66 thereupon being locked in its up position by the action of the locking valve 83. The operation of the carriage up limit switch 116 also energizes the clamp up solenoid coil 120 over line 132 and now closed contacts 1 and 3 of relay R5.

Upon the operation of the clamp up solenoid coil 120 the clamp cylinders 68, 68 move the two clamp bars upwardly. As mentioned previously, the flow control valve 96 of FIG. 3 assures that the right-hand cylinder 68 reaches its up position first, and when the left-hand clamp cylinder reaches its up position the clamp up limit switch 92 is operated. The operation of this limit switch causes relay R5 to be deenergized by removing power from the line 146. The deenergization of relay R5 in turn deenergizes the clamp up solenoid coil 120 by the opening of its terminals 1 and 3 and the motor relay coil 128 is deenergized, to turn off the pump motor by the opening of terminals 6 and 7 of R5.

At this point the cycle is ended. The carriage is in its up position and locked in that position by the locking valve 83 and the clamp bars are likewise in their up position and locked in that position by the locking valve 90, and the pump motor is turned off. The operator may now remove the package of work product from the carriage after allowing sufficient time for excess liquid to drain therefrom and fall back into the tank. A new package of work product is then placed on the carriage and a new cycle of operation initiated by pushing the cycle button 114.

I claim:

1. A hoist for dipping a package of work product into a tank of liquid, said hoist comprising:

a pair of stationary vertical posts adapted to have their lower end portions received in and fixed relative to a tank such as aforesaid and their upper end portions extending upwardly out of said tank, a carriage slidably supported on said two posts for vertical movement relative thereto, said carriage having a set of generally horizontal prongs at its lower end for receiving a package of work product placed thereon, said carriage also having at least one clamp located upwardly from said set of prongs movable vertically relative to said carriage into and out of engagement with a package of work product placed on said prongs, means for moving said clamp vertically relative to said carriage into and out of engagement with a package of work product placed on said prongs, and means for moving said carriage vertically relative to said posts to move said carriage into and out of the tank with which said hoist is associated.

2. A hoist as defined in claim 1 further characterized by said two posts being adapted to be located in the rear portion of said tank and said prongs extending forwardly from the remainder of said carriage, said prongs having upper surfaces slightly inclined to the horizontal, and said carriage including at the rear of each of said prongs a vertical member having a forward surface perpendicular to said inclined upper surface of the associated prong so that a package of generally rectangular cross section is held on said carriage in a slightly tipped condition promoting the drainage of liquid from said package after said package is raised from said tank.

3. A hoist as defined in claim 1 or claim 2 further characterized by said at least one clamp including a clamp carrier movable vertically relative to the remainder of said carriage and a package engaging clamp bar extending in generally the same direction as said prongs and pivotally connected intermediate its ends to said clamp carrier for movement relative thereto about a horizontal pivot axis perpendicular to its length.

4. A hoist as defined in claim 1 or claim 2 further characterized by said carriage including two side members each extending along a portion of a respective one of said stationary posts, bearings at opposite ends of each of said carriage side members for slidably engaging the associated stationary posts, and a clamp barrier slidable on each of said carriage side members, and a package engaging clamp bar carried by each of said clamp carriers, each of said clamp bars extending in generally the same direction as said prongs and each being connected intermediate its length to its associated clamp carrier for pivotal movement about a horizontal axis perpendicular to its length.

5. A hoist as defined in claim 4 further characterized by said bearings being made of ultra-high molecular weight plastic.

6. A hoist as defined in claim 1 further characterized by said means for moving said clamp being a hydraulic clamp cylinder, and said means for moving said carriage being a hydraulic carriage cylinder, and a control means including a "cycle" button and a means responsive to operation of said "cycle" button for causing said hoist to undergo a complete cycle of operation which cycle includes the sequential steps of: (1) lowering said clamp into engagement with a package on said prongs to clamp said package to said carriage, (2) lowering said carriage into said tank, (3) keeping said carriage in its lowered position for a predetermined immersion time period, (4) raising said carriage from said tank at the end of said immersion time period, and (5) raising said clamp to unclamp said package from said carriage.

7. A hoist as defined in claim 6 further characterized by said control means including a time delay device providing a predetermined period of time for movement of said clamp from its raised to its package engaging position.

8. A hoist as defined in claim 6 further characterized by said control means including a time delay device having an adjustable time delay period for controlling the length of said immersion period.

9. A hoist as defined in claim 6 further characterized by a hydraulic pump for supplying hydraulic fluid to said clamp and carriage cylinders, a motor for driving said pump, and said control means including a means for turning said motor on immediately upon the operation of said "cycle" button, for turning said motor off at the beginning of said immersion period, for turning said motor on at the end of said immersion period, and for subsequently turning said motor off when said clamp is returned to its raised position at the end of a cycle.

10. A hoist as defined in claim 9 further characterized by locking valves associated with said clamp cylinder and with said carriage cylinder for preventing flow of hydraulic fluid from out of either end of each cylinder when no pressurized fluid is supplied to either end of the cylinder.

11. A hoist as defined in claim 10 further characterized by said carriage having two clamps and two clamp cylinders connected in parallel and energized through a single solenoid valve, said control means including a "clamp up" limit switch associated with one of said clamp cylinders for sensing the "up" position of its associated clamp, and a flow control valve associated with said one clamp cylinder, said flow control valve including a check valve permitting unimpeded flow to said cylinder during movement of its clamp in the down direction and including an adjustable needle valve slowing the speed of said one cylinder during movement of its clamp in the up direction thereby assuring that said other cylinder raises its clamp to the full upper position before said one cylinder raises its clamp to its full up position and operates said "clamp up" limit switch.

12. A hoist for dipping a package of work product into a tank of liquid, said hoist comprising a carriage supported for vertical movement into and out of a tank of liquid such as aforesaid, said carriage having a means providing an upwardly facing support surface for engaging the lower surface of a package, and a clamp means on said carriage located above said upwardly facing package receiving surface and movable vertically relative to the remainder of said carriage into and out of engagement with the top surface of a package on said support surface to clamp and unclamp such package relative to said carriage, a clamp hydraulic cylinder for driving said clamp means, a carriage hydraulic cylinder for driving said carriage, a clamp solenoid valve for controlling said clamp cylinder, a carriage solenoid valve for controlling said carriage cylinder, a "clamp up" limit swtich on said carriage for sensing the upward limit of said clamp means relative to said carriage, a "carriage up" limit switch for sensing the upward limit of said vertical movement of said carriage relative to said tank, a "carriage down" limit switch for sensing the down limit of said vertical movement of said carriage relative to said tank, a "cycle" push button for starting a cycle of hoist operation, means responsive to the operation of said "cycle" push button for energizing said clamp solenoid to cause said clamp cylinder to move said clamp means downwardly, a first time delay means providing a first time delay period starting with the operation of said "cycle" push button, means responsive to the running of said first time delay period for deenergizing said clamp solenoid and for energizing said carriage solenoid to cause said carriage cylinder to lower said carriage into said tank, means responsive to operation of said "carriage down" limit switch for deenergizing said carriage solenoid, a second time delay means providing a time delay period starting with the operation of said "carriage down" limit switch, means responsive to the running of said second time delay period for energizing said carriage solenoid to cause said carriage cylinder to raise said carriage out of said tank, means responsive to operation of said "carriage up" limit switch for deenergizing said carriage solenoid and for energizing said clamp solenoid to cause said clamp cylinder to move said clamp upwardly away from said package, and means responsive to operation of said "clamp up" limit switch for deenergizing said clamp solenoid.

13. A hoist as defined in claim 12 further characterized by a hydraulic pump and motor for supplying pressurized hydraulic fluid to said solenoid valves and cylinders, and said control means including means for turning said motor on in response to the operation of said "cycle" button and means for turning said motor off in response to the operation of said "clamp up" limit switch at the end of a cycle.

14. A hoist as defined in claim 13 further characterized by means for turning said motor off at the beginning of said second time delay period and for turning said motor on at the end of said second time delay period.

* * * * *